US008117967B2

(12) United States Patent
Salvel

(10) Patent No.: US 8,117,967 B2
(45) Date of Patent: Feb. 21, 2012

(54) BULLET

(75) Inventor: Manuel F. Salvel, Schaffhausen (CH)

(73) Assignee: Saltech AG, Dulliken (CH)

( * ) Notice: Subject to any disclaimer, the term of this patent is extended or adjusted under 35 U.S.C. 154(b) by 0 days.

(21) Appl. No.: 11/816,483

(22) PCT Filed: Feb. 13, 2006

(86) PCT No.: PCT/CH2006/000093

§ 371 (c)(1),
(2), (4) Date: Nov. 13, 2007

(87) PCT Pub. No.: WO2006/086902

PCT Pub. Date: Aug. 24, 2006

(65) Prior Publication Data

US 2008/0264290 A1 Oct. 30, 2008

(30) Foreign Application Priority Data

Feb. 16, 2005 (CH) ..... 270/05

(51) Int. Cl.
*F42B 30/00* (2006.01)

(52) U.S. Cl. ..... 102/517; 102/518

(58) Field of Classification Search ..... 102/517, 102/518

See application file for complete search history.

(56) References Cited

U.S. PATENT DOCUMENTS

| | | | | | |
|---|---|---|---|---|---|
| 3,338,167 | A | * | 8/1967 | Jungermann et al. | 102/529 |
| 3,348,485 | A | * | 10/1967 | Dufour | 102/518 |
| 3,580,178 | A | * | 5/1971 | Kopsch et al. | 102/515 |
| 3,780,657 | A | | 12/1973 | Zaid | |
| 4,716,835 | A | * | 1/1988 | Leemans | 102/529 |
| 6,119,600 | A | * | 9/2000 | Burri | 102/518 |
| 6,374,743 | B1 | * | 4/2002 | Hug et al. | 102/518 |
| 6,457,417 | B1 | * | 10/2002 | Beal | 102/517 |

FOREIGN PATENT DOCUMENTS

| | | | |
|---|---|---|---|
| EP | 0 563 552 | A1 | 10/1993 |
| EP | 0 752 571 | A1 | 1/1997 |
| WO | 99/10703 | A1 | 3/1999 |

* cited by examiner

*Primary Examiner* — Michael Carone
*Assistant Examiner* — Samir Abdosh
(74) *Attorney, Agent, or Firm* — Sughrue Mion, PLLC

(57) ABSTRACT

A projectile (10), where necessary covered with a jacket, possesses a front-side core (1) and a rear-side core (2). The rear-side core (2) here bears positively in a centered manner against the front-side core (1) and this rear-side core (2) fills the entire cylindrical and the frustoconically configured rear region (2) of the projectile (10). A contact zone (11, 12 is respectively configured on the two cores (1, 2), which contact zone allows the projectile (10) to be joined together in a press fit, a perfectly aligned external form (3) of the projectile (10) being obtained and the contact faces (15; 13; 11 to 12) of the cores (1, 2) directly touching one another substantially without a clearance or gap over the whole of the contact face (15; 13; 11 to 12). When the projectile (10) impacts upon a surface oriented in any chosen manner relative to the firing direction (20), the projectile (10) is split into two less dangerous projectile parts.

28 Claims, 1 Drawing Sheet

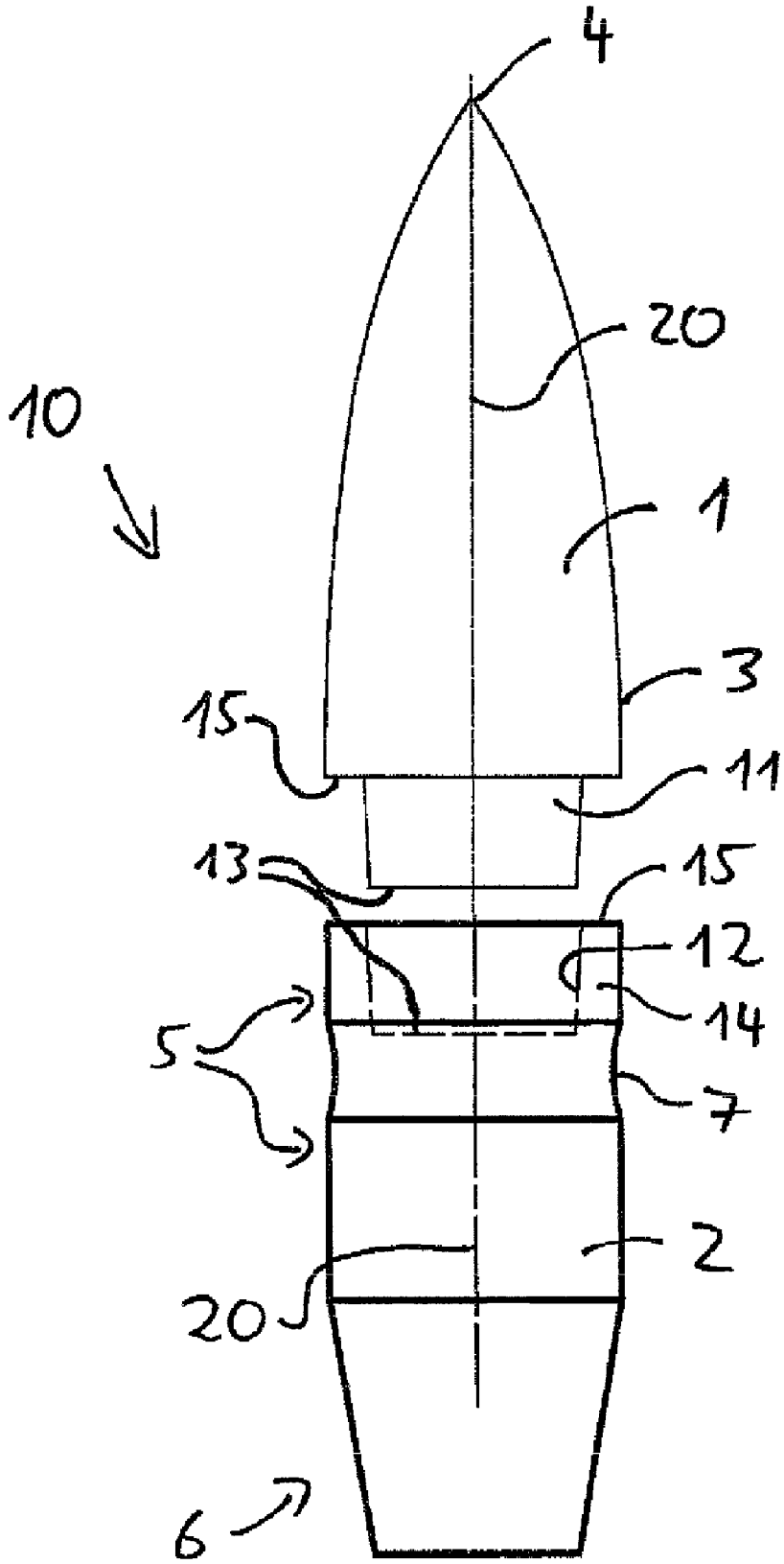
4
20
10
1
3
15
11
13
15
12
14
5
7
2
20
6

BULLET

The invention relates to a projectile, where necessary covered with a jacket, having a front-side core and having a rear-side core, the external form of the projectile, viewed starting from the projectile nose, being of ogive-shaped configuration, transforming into a cylindrical middle region and ending in a conical rear region, the rear-side core bearing positively in a centred manner against the front-side core and this rear-side core filling the entire cylindrical and the frustoconically configured rear region of the projectile.

Such a projectile is known, in the form of a jacketed projectile, from WO 99/10703, two-part projectiles having already been known for more than 60 years, for example from GB 601 686. The centric positive-locking matching of the rear-side core to the front-side core allows a projectile designed according to WO 99/10703 to be offered good aerodynamic, ballistic and, above all, penetrative characteristics for sharpshooter applications.

From DE 100 05 412, a training projectile is known which has a reduced range. It comprises a projectile nose connected by predetermined breaking points to a rear core. When the projectile is fired, it breaks up as a result of the inertia of mass of the projectile nose, so that only a reduced range is achieved.

U.S. Pat. No. 6,263,798 describes a projectile which is produced at elevated temperature yet below the sintering temperature, so that, upon impact, it fragments directly and completely into powder form. This publication indicates that this method is also suitable for the manufacture of lead-free training ammunition.

The said training ammunitions according to the prior art are expensive to make and their firing behaviour does not correspond, at higher ranges, to that of combat ammunition.

Starting from this prior art, the object of the invention is to define a projectile which can be manufactured more cheaply, and also in a lead-free manner, as training ammunition.

A further object consists in improving the ricochet behaviour when the projectile designed as a training ammunition makes a non-frontal impact, i.e. in more reliably eliminating the danger to third parties posed by ricocheting and onward travel of the projectile.

Finally, an object of the present invention is to define a training ammunition which can be used at the same distances as combat ammunition, i.e. which has essentially the same ballistic characteristics up to the point of impact.

This object is achieved for a projectile of the type defined in the introduction by the characterizing features of claim 1.

The fact that the projectile leaves the gun barrel as a one-piece element allows flight behaviour to be achieved which, in terms of velocity and flight path, is similar to that of combat ammunition. The fragmentation of the projectile into two, for example, approximately equal-sized parts upon impact at more or less any ricochet angle removes the danger to third parties, without having to resort to the disintegration of the training ammunition into powder form or similar. By designing the ammunition as a pure steel projectile, manufacturing costs are reduced. Furthermore, special functions such as light trace, etc., can be easily integrated.

Advantageous embodiments are characterized in the subclaims.

The invention is now described in greater detail with reference to the single FIGURE, which represents an exploded view of a projectile.

The single FIGURE shows a two-part projectile 10, which is here configured without a jacket. It possesses a front-side core 1 and a rear-side core 2. The external form 3 of the projectile 10, viewed starting from the projectile nose 4, is of ogive-shaped configuration and transforms into a cylindrical middle region 5 and ends in a conical rear region 6. The middle region 5 possesses a circumferential rounded groove 7. The two cores 1 and 2 consist of solid material.

Here, the rear-side core 2 is mounted positively, in a centred manner, on the front-side core 1 with the aid of a contact zone, bearing the reference symbols 11 and 12. The size relationships of front-side core 1 and rear-side core 2 are here such that this rear-side core 2 fills the whole of the cylindrical middle region 5 and the frustoconically configured rear region 6 of the projectile 10. The connection between the two cores 1 and 2 can be a press fit, which here means, for example, that the two cores 1 and 2 cannot be separated by the simple impairment of shearing forces by a user. The fits can be specified with suitable precision according to ISA. To this extent, other fits, too, are possible. Of fundamental importance is the action of joining together the projectile 10, which gives rise to a joint which does not weaken under gravitational force. It is also possible for the connection of the projectile halves to be a clamped joint and/or a frictional engagement, provided that the parts are guaranteed to come apart only in the event of an impact, even at a narrow angle. The fact that, in use, the projectile 10 is substantially acted upon by forces in the longitudinal direction helps to hold the projectile together.

If, on the other hand, the projectile 10, fired from a gun, does not hit frontally upon a surface, for example upon a surface which stands, for example, at an angle of between 5 and 30 degrees to the direction of flight, i.e. the longitudinal axis 20, of the projectile 10, then sufficient shearing forces act upon the projectile 10 and it splits into the two cores 1 and 2, whereby the further danger zone after the ricochet shot is severely diminished. When the projectile 10 impacts upon a surface oriented in any chosen manner relative to the firing direction 20, the projectile 10 is thus split into two less dangerous projectile parts.

Suitable embodiments of the contact zones of the two cores 1 and 2 comprise a central truncated cone 11 of the front-side core 1 with an angle of between 1 and 20 degrees, preferably between 2 and 10 degrees, more particularly of 3 degrees, relative to the longitudinal axis 20 of the projectile 10, and a complementary cone 12 of the rear-side core 2, which cone 12 is suitable for the press fit or a clamped joint. This advantageously has almost the same angle as, in particular a somewhat smaller angle than, the truncated cone 11, for example an angle which is 0.2 to 1 degree smaller, in particular 0.5 degree smaller, i.e. here an angle of 2.5 degrees relative to the longitudinal axis 20 with a 0.03 millimeter smaller inner diameter of the rear-side frustoconical core cone 12, when the two stop faces 13 of the two cores 1 and 2 are forced together, with the result that no air gap exists at the faces 13.

In the illustrative embodiment which is represented here, the thickness of the wall 14 of the rear-side core cone 12 at the stop face 13, i.e. in the cylindrical middle region 5, measures 1.17 millimeters, at an outer diameter of 10.884 millimeters. In particular, the wall thickness of the frustoconical hollow cone 12 can measure between ⅕ and ⅓ of the diameter of the projectile 10 in its cylindrical portion.

The dimensions of the stop faces 15, on the other hand, are identical at both the cores 1 and 2. Like the faces 13, the stop faces 15 run in a plane perpendicular to the longitudinal direction 20 of the projectile 10. The depth and height, respectively, of the cones 11 and 12 is preferably identical, so that, when the cores 1 and 2 are forced or pressed together, a projectile 10 is obtained which is perfectly aligned on the outer side. In this illustrative embodiment, the height of the front-side core cone 11 measures 4 millimeters and thus between ¼ and ⅛, here ⅙, of the length of one of the two cores 1 or 2.

In place of the cones 11 and 12 of the cores 1 and 2, substantially complementary cylindrical elements can also engage in one another.

The cores 1 and 2 are here advantageously formed from identical material. In particular, the two cores 1 and 2 both consist of steel of similar hardness or the same steel, so that a single-material joint, clamped joint or press fit is obtained. Compared to the projectiles according to the prior art, manufacture is very simple. In particular, the hard front-side core 1, and then the soft rear-side core 2, does not have to be pressed into a jacket of the projectile 10.

The length of the front-side core 1 measures 24 millimeters, for example, whilst the length of the rear-side core 2 measures, for example, 23 millimeters. Due to the outer form of the cores 1 and 2, therefore, an equal weight distribution is given. Upon impact of the projectile 10, therefore, two substantially equal-sized and equal-weight fragments are formed. The length or the weight ratio of the cores 1 and 2 one to the other can be chosen, for example, between 1:3 and 3:1, advantageously between 1:2 and 2:1, and even more preferably, between 1:1.3 and 1.3:1.

In another illustrative embodiment of the invention, the projectile 10 can also be designed as a jacketed projectile, in which case the jacket of the projectile 10 only exhibits guidance characteristics in the barrel and is thus designed sufficiently thin that the jacket in no way interferes with the destruction of the projectile 10 when the projectile 10 hits a target. In the manufacture of such a jacketed projectile, the two-part cores 1 and 2 represented in the FIGURE are then advantageously first forced together, before a jacket is pressed over the projectile 10 thus formed. This jacket can, in particular, be crimped into the groove 7.

In place of a truncated cone 11 on the front-side core 1 and a hollow truncated cone 12 on the rear-side core 2, the two-part projectile 10 can also be constructed precisely the other way round, in which case the walls 14 are configured on the front-side core 1.

The invention claimed is:

1. A dual core projectile, comprising:

a front-side core comprising a projectile nose, a contact face and a first contact zone, and a rear-side core comprising a second contact zone, a contact face, a cylindrical middle region and a frustoconical rear region, wherein the external form of the projectile, viewed starting from the projectile nose, being of ogive-shaped configuration, transforming into a cylindrical middle region and ending in a conical rear region, wherein the rear-side core bearing positively in a centred manner against the front-side core, obtaining a perfectly aligned external form of the projectile, and wherein the first and second contact zones provide a positive fit that allows the front side core and the rear side core to be joined together in a joint that is secure under gravitational force, and the contact faces of the front-side core and of the rear-side core directly touching one another, substantially without a clearance or gap over the whole of the contact faces and wherein the front-side core and the rear-side core consist of steel.

2. The projectile according to claim 1, wherein the first contact zone is a frustoconical cone and the second contact zone is a frustoconical hollow cone.

3. The projectile according to claim 2, wherein the central truncated cone of the first contact zone is configured with an angle of between 1 and 20 degrees, wherein the frustoconical hollow cone of the second contact zone has an angle which is 0.2 to 1degree smaller than the angle of the central truncated cone.

4. The projectile according to claim 2, wherein the wall thickness of the frustoconical hollow cone of the second contact zone measures between ⅕ and ⅓ of the diameter of the projectile at its cylindrical portion.

5. A projectile according to claim 2, wherein the height of the central truncated cone of the first contact zone measures between ¼ and ⅛ of the length of one of the two cores, given the same units of measurement.

6. The projectile according to claim 2, wherein the cylindrical portion of the rear core possesses a circumferential groove.

7. The projectile according to claim 1, wherein the length or weight ratio of the cores one to the other, given the same units of measurement, measures between 1:2 and 2:1.

8. The projectile according to claim 1, wherein the front-side core and the rear-side core of the joined-together projectile stand in one of a clamped joint, a frictional engagement or a press fit one to the other.

9. A dual core projectile, comprising:

a front-side core comprising a projectile nose and a first contact zone, a rear-side core comprising a second contact zone, a cylindrical middle region and a frustoconical rear region, and a jacket covering front-side core and rear-side core, wherein the external form of the projectile, viewed starting from the projectile nose, being of ogive-shaped configuration, transforming into a cylindrical middle region and ending in a conical rear region, wherein the rear-side core bearing positively in a centred manner against the front-side core, obtaining a perfectly aligned external form of the projectile, wherein the first and second contact zones provide a positive fit that allows the front side core and the rear side core to be joined together in a joint that is secure under gravitational force, and the contact faces of the front-side core and of the rear-side core directly touching one another, substantially without a clearance or gap over the whole of the contact faces and wherein the front-side core and the rear-side core consist of steel.

10. The projectile according to claim 9, wherein the front-side core and the rear-side core of the joined-together projectile stand in a clamped joint, in a frictional engagement or in a press fit one to the other.

11. The projectile according to claim 9, wherein the cylindrical portion of the rear core possesses a circumferential groove for the crimping of a projectile jacket.

12. The projectile according to claim 1, wherein the central truncated cone of the first contact zone is configured with an angle of between 2 and 10 degrees or 3 degrees and wherein the frustoconical hollow cone of the second contact zone has an angle which is 0.5 degree smaller than the angle of the central truncated cone.

13. The projectile according to claim 12, wherein the central truncated cone of the first contact zone is configured with an angle of 3 degrees.

14. The projectile according to claim 1, wherein the height of the central truncated cone of the first contact zone measures ⅙ of the length of one of the two cores.

15. The projectile according to claim 1, wherein the projectile comprises a jacket, which is designed sufficiently thin that the jacket in no way interferes with the destruction of the projectile when the projectile hits a target.

16. The projectile according to claim 9 wherein the projectile comprises a jacket, which is designed sufficiently thin that the jacket in no way interferes with the destruction of the projectile when the projectile hits a target.

17. A dual core projectile, comprising:

a front-side core comprising a projectile nose, a contact face and a first contact zone, and a rear-side core comprising a second contact zone, a contact face, a cylindrical middle region and a frustoconical rear region, wherein the external form of the projectile, viewed starting from the projectile nose, is of an ogive-shaped configuration, transforming into a cylindrical middle region and ending in a conical rear region, wherein the rear-side core bears positively in a centered manner against the front-side core, obtaining a perfectly aligned external form of the projectile, wherein the first contact zone is a frustoconical cone extending from a first circular surface, which is arranged such that the first circular surface encompasses said frustoconical cone, wherein the second contact zone is a frustoconical hollow cone extending from a second circular surface into the rear-side core, which second circular surface encompasses said frustoconical hollow cone, wherein the first circular surface is congruent to the second circular surface and the frustoconical cone is congruent to the frustoconical hollow cone such that the first and second contact zones provide a positive fit that allows the front side core and the rear side core to be joined together in a joint that is secure under gravitational force, and the contact faces of the front-side core and of the rear-side core are directly touching one another, substantially without a clearance or gap over the whole of the contact faces, and wherein the front-side core and the rear-side core consist of steel.

18. The projectile according to claim 17, wherein the central truncated cone of the first contact zone is configured with an angle of between 1 and 20 degrees, and wherein the frustoconical hollow cone of the second contact zone has an angle which is 0.2to 1 degree smaller than the angle of the central truncated cone.

19. The projectile according to claim 17, wherein the wall thickness of the frustoconical hollow cone of the second contact zone measures between ⅕ and ⅓ of the diameter of the projectile at its cylindrical portion.

20. The projectile according to claim 17, wherein the height of the central truncated cone of the first contact zone measures between ¼ and ⅛ of the length of one of the two cores.

21. The projectile according to claim 17, wherein the cylindrical portion of the rear core possesses a circumferential groove.

22. The projectile according to claim 17, wherein the length or weight ratio of the cores one to the other measures, between 1:2 and 2:1.

23. The projectile according to claim 17. wherein the front-side core and the rear-side core of the joined-together projectile stand in one of a clamped joint, a frictional engagement or a press fit one to the other.

24. The projectile according to claim 17, wherein the projectile comprises a jacket, which is designed sufficiently thin that the jacket in no way interferes with the destruction of the projectile when the projectile hits a target.

25. The projectile according to claim 17, wherein said first circular surface and said second circular surface fully encompass the respective cone around said cone's perimeter.

26. The projectile as claimed in claim 17, wherein the first circular surface having the shape of a ring as viewed along a centre axis and wherein the second circular surface having the shape of a circular area.

27. The projectile as claimed in claim 26, wherein the first circular surface comprises a flat plane that is orthogonal to said centre axis and ends at said frustoconical hollow cone and wherein the second circular surface comprises a flat plane that is orthogonal to said centre axis and ends at said frustoconical cone.

28. The projectile as claimed in claim 27, wherein the radial dimension of the ring extending from the centre axis to an inner circumference of the ring is substantially the same as the radial dimension of the circular area extending from the centre axis to an outer circumference of the circular area.

* * * * *